United States Patent [19]

Maximoff

[11] 3,977,759

[45] Aug. 31, 1976

[54] TERMINAL FOR WIRES OF VARIOUS GAUGES

[76] Inventor: Paul A. Maximoff, 115 Brixham Place, Schaumberg, Ill. 60172

[22] Filed: Apr. 28, 1975

[21] Appl. No.: 572,230

[52] U.S. Cl. ..... 339/275 B

[51] Int. Cl.[2] ..... H01R 9/06

[58] Field of Search ..... 339/220, 221, 258, 275

[56] References Cited

UNITED STATES PATENTS

| | | | |
|---|---|---|---|
| 1,936,404 | 11/1933 | Miner | 339/275 B |
| 2,689,337 | 9/1954 | Burtt et al. | 339/275 T |
| 3,156,517 | 11/1964 | Maximoff et al. | 339/275 B |
| 3,348,192 | 10/1967 | De Vito | 339/275 T |
| 3,686,625 | 8/1972 | Krehbiel, Sr. et al. | 339/275 B |

*Primary Examiner*—Joseph H. McGlynn

*Attorney, Agent, or Firm*—Leo J. Aubel; Robert E. Wagner; Gerald T. Shekleton

[57] ABSTRACT

A terminal connector, for use with subassemblies, including a wire retention arm, a wire stop and solder inlets whereby a large range of wire gauges may be satisfactorily retained during the assembly process and prior to soldering through the interaction of a resilient arm and a wire stop, and a continuous ring around the connector's midsection that is biased against a subassembly by the deformation of an end of the connector.

5 Claims, 6 Drawing Figures

TERMINAL FOR WIRES OF VARIOUS GAUGES

BACKGROUND OF THE INVENTION

This invention relates in general to an improvement in electrical terminal connectors and more specifically to improvements in a connector for use with subassemblies.

As is well known in the terminal connector art, various structures and expedients have been utilized to mount and retain electrical terminal connectors on the associated bases. Among such expedients may be mentioned rivets, screws, separable clamps, special clips and the like. One disadvantage of such prior expedients has been that they have required separate parts on, connected to, or arranged to be assembled with the subassembly, thus adding to the cost of the subassembly structure, making it tend to malfunction, become loose or other deficiencies.

SUMMARY OF THE INVENTION

Accordingly, the present invention is directed to providing an improved electrical terminal connector particularly suited for use with a subassembly or printed circuit boards or with other suitable means of support (but not necessarily limited thereto), which terminal is adapted to receive and hold securely for subsequent soldering, an electrical lead or wire, which may be of different gauge sizes and be of either stranded or solid construction.

As already mentioned, terminals will frequently be adapted to a specific range in the gauges of wires it can accept. The present invention is directed to overcoming the foregoing and other deficiencies and disadvantages of the prior constructions. More particularly, by the present invention, effective, satisfactory and reliable temporary retention of a wide range of wire gauges is effected. For this purpose, the terminal of the present invention provides for a spring arm in its upper or lead receiving portion and wire stops in the solder well portion. Thus when a wire is inserted into the connector, it penetrates through to the wire stop and is secured by the spring arm.

Moreover, the terminal may be stamped, formed and mounted with the use of inexpensive devices and in a simple, yet highly effective manner.

An important object of the present invention therefore is the provision of a means of retaining a wide range of wire sizes in an electrical terminal used in a subassembly.

An equally important object of the present invention is to provide a new and simplified means for mounting an electrical connection on a supporting panel.

Another object of the present invention is to provide for the cooperation and supplementation of a spring arm and a wire stop in an electrical terminal for an increased capacity in the retention of different sizes of wires prior to soldering.

A further object of this invention is to provide an electrical connector which is capable of being formed to fit subassemblies of various thickness with the same degree of rigidity and secure fit.

Other objects, features and advantages of the invention will be readily apparent from the following description of a preferred embodiment thereof, taken in conjunction with the accompanying drawing, although variations and modifications may be effected without departing from the spirit and scope of the novel concept of the disclosure, wherein.

DESCRIPTION OF THE INVENTION

Figure 1:
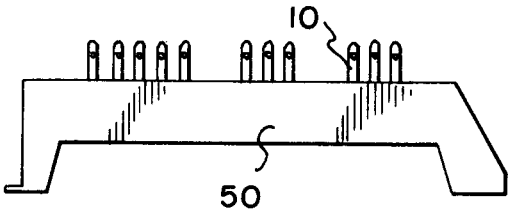
FIG. 1 shows a side view of the preferred embodiment mounted in a subassembly.

Referring now to the drawings and in particular to FIG. 1, the connector 10 is shown mounted in array in one form of an associated subassembly.

Figure 4:
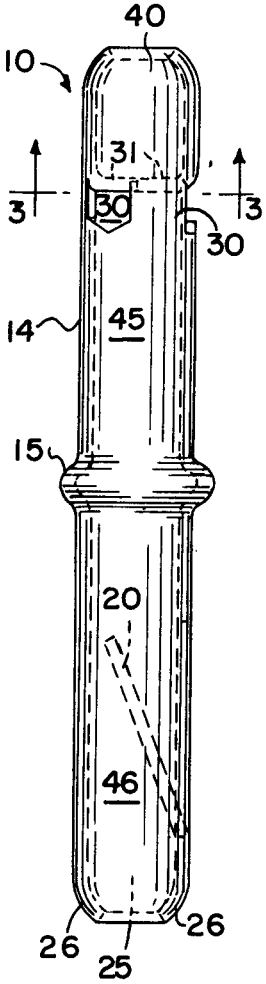
FIG. 4 shows a side view of the preferred embodiment of this invention.

In FIG. 4 the connector 10 of the preferred embodiment of the present invention is a narrow tubular structure having an integral continuous ring or bulge at its midsection thus defining the structure as one having a lead receiving section 46 and a solder contacting section 45. The terminal 10 has an open end 27 (See FIG. 6) for receiving the electrical lead wires. This open end 27 is formed from the smaller initial opening 25 in a manner yet to be described. The opposite end 40 forms a substantially closed end, and is the source of electrical contact when in combination with an associated female connector.

Figure 5:
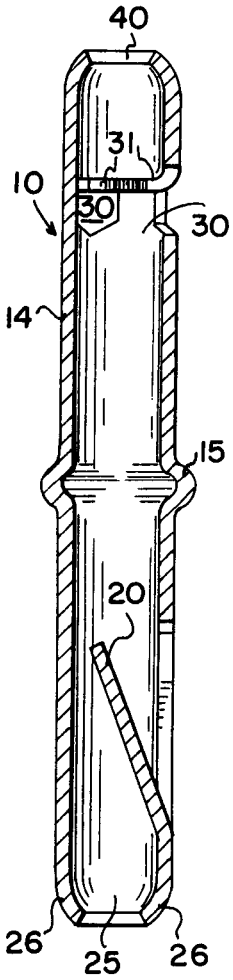
FIG. 5 shows the preferred embodiment of FIG. 4 in cross section.

A resilient arm 20 is formed on the lead receiving section of the terminal 10. This arm is struck from the body and bent inwardly at an angle thereby forming a springlike arm, which applies pressure to any electrical wires introduced into the terminal, for the retention of such wires. This feature can be seen better in FIG. 5 wherein the resilient arm 20 is shown bent inside the body of the terminal 10 and at an angle to the outside walls 14 of the terminal.

Figure 3:
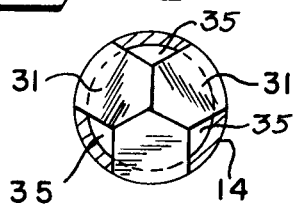
FIG. 3 shows a cross section on the lines 3—3 of FIG. 4.

On the solder contacting section 45 of the terminal of the preferred embodiment of the present invention three small pentagonal openings are punched into the walls 14 of the terminal at a short distance from the substantially closed end 40. These openings 30 are formed by striking the walls 14 of the connector and bending these sections 31 inwardly until they are at substantially right angles to the walls 14. The resulting wire stops 31 are shown in FIG. 3 in cross-section wherein it can be seen that a wire will bear against or rest on these wire stops 31. These pentagonal stops 31 assure that virtually all of the interior of the connector is blocked while maintaining the strength and unitary construction of the connector. Not only does this eliminate the extra assembly time necessary for other components, which would otherwise have to be added on to the connector to supply these features, but it also contributes to an inexpensive method of manufacture.

Figure 2:
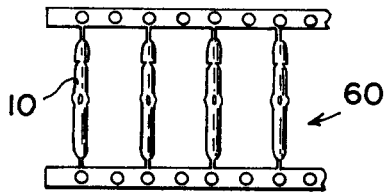
FIG. 2 shows the side view of a preferred embodiment as stamped and formed.

The terminal itself is initially made in a continuous strip form 60 as shown in FIG. 2. This enables the terminals 10 to be made in a continuous process and rolled into larger shipping units thereby facilitating mass production. The terminals are stamped, formed, and the exterior is plated with chromium or other suitable substance whereby the solder or other tinning agent is repelled from the surface and a clean exterior is preserved after the soldering process is complete.

Figure 6:
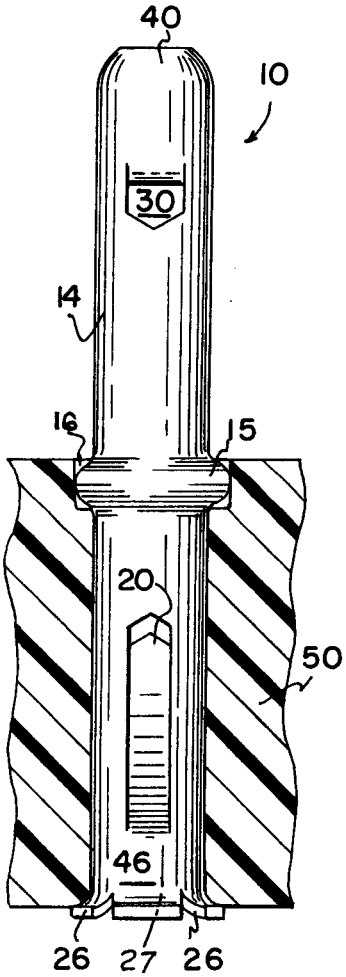
FIG. 6 shows the preferred embodiment of this invention mounted in a subassembly with the subassembly being in cross section thereof.

In the preferred embodiment of the present invention terminal 10 is placed in an appropriate subassembly 50 as in FIG. 6 whereby the midsection ring 15 allows penetration of the terminal 10 in the subassembly 50 to such a depth that the lead receiving 26 of the upper section 46 may be deformed, or pushed outwardly and flattened against the subassembly 50, thereby tightly securing the terminal to the subassembly as shown in FIG. 6 and forming the lead opening 27 from initial opening 25. It is important to note that the placement of the midsection ring 15 will be dependent upon the thickness of the supporting subassembly 50, so as to assure a tight fit in all cases.

It is preferable to seat the midsection ring 15 in a depression 16, as in FIG. 6, so that no portion of the midsection ring protrudes above the surface of the subassembly 50. In this manner the subassembly structure of the corresponding female connector (not shown) will be capable of being positioned immediately adjacent the subassembly 50 of the connector 10, thereby excluding dirt and other foreign matter, and preventing dirty contact surfaces.

During assembly of the wires in the terminals the wires are inserted through the opening 30 thus formed, and retained by the flexible arm 20 in conjunction with the wire stops 31. The wires are thereby tightly secured and will withstand a large amount of handling stress enabling a great number of such terminals inserted into a subassembly to be submerged en masse into a solder bath while assuring that the wires inserted in the terminals are not disconnected or loosened. Upon insertion into the solder tank, the chromium exterior repels the solder while the openings 30 admit the solder onto the surface of the wire and the uncoated interior of the connector thereby making a solid electrical connection upon cooling.

In such a manner a good electrical connection is assured while maintaining a clean exterior that does not impair the physical connection and fit of the corresponding female connector. Thus it can be seen that the present invention facilitates the construction and use of the various subassemblies with which the electrical terminal of the present invention is intended to be used.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope therof. Therefore it is intended that the invention not be limited to the particular embodiment disclosed as the best mode contemplated for carrying out this invention, but that the invention will include all embodiments falling within the scope of the appended claims.

I claim:

1. An electrical connector for receiving an electrical lead, said connector comprising an elongated tubular housing having a solder receiving section and a substantially closed end contiguous with an electrical lead receiving section having an open end, which open end receives the lead, an integral continuous ring formed intermediate the ends of said housing; a resilient arm bent inwardly from the housing for biasing the received electrical lead against said housing, said solder receiving section having a plurality of portions struck from said housing each of said portions forming at least a substantially pentagonal shape and bent inwardly for providing openings for solder flow thereinto.

2. The terminal connector of claim 1 wherein said exterior walls are chromium plated to repel the solder from said exterior walls of said terminal connector.

3. The electrical connector of claim 1 adapted to be mounted on an associate support member wherein in said connector said open end is deformable and said integral continuous ring encompassing said housing is spaced at a distance from the open end corresponding to a preselected length whereby said preselected length is approximately equal to the thickness of the associated support member thereby causing said connector to be securely mounted in the associated support member when said open end is deformed to bear against the support member.

4. An electrical connector as in claim 1 wherein there are three of said openings formed in said solder receiving section.

5. The terminal connector of claim 4 wherein said openings are struck in a substantially pentagonal shape.

* * * * *